US008893921B2

(12) United States Patent
Miki et al.

(10) Patent No.: US 8,893,921 B2
(45) Date of Patent: Nov. 25, 2014

(54) PAPER SHEET STORING/FEEDING DEVICE

(75) Inventors: Isao Miki, Hyogo (JP); Yoshikazu Mitsusada, Hyogo (JP); Takeshi Kirihara, Gumma (JP); Takashi Ando, Gumma (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 239 days.

(21) Appl. No.: 13/395,678

(22) PCT Filed: Sep. 28, 2009

(86) PCT No.: PCT/JP2009/066730

§ 371 (c)(1),
(2), (4) Date: Mar. 13, 2012

(87) PCT Pub. No.: WO2011/036783

PCT Pub. Date: Mar. 31, 2011

(65) Prior Publication Data

US 2012/0181298 A1 Jul. 19, 2012

(51) Int. Cl.

| | |
|---|---|
| ***B65H 5/28*** | (2006.01) |
| ***B65H 29/00*** | (2006.01) |
| ***G07D 11/00*** | (2006.01) |

(52) U.S. Cl.

CPC ..... *B65H 29/006* (2013.01); *G07D 11/0006* (2013.01); *B65H 2301/41912* (2013.01); *B65H 2403/72* (2013.01); *B65H 2403/732* (2013.01); *B65H 2404/162* (2013.01); *B65H 2511/51* (2013.01); *B65H 2701/1912* (2013.01)

USPC ..... 221/71; 242/528

(58) Field of Classification Search

USPC ..... 242/528; 221/71

See application file for complete search history.

(56) References Cited

U.S. PATENT DOCUMENTS

| | | | | |
|---|---|---|---|---|
| 8,215,579 | B2 * | 7/2012 | Mizoro | 242/528 |
| 8,342,439 | B2 * | 1/2013 | Iwatsuki | 242/528 |
| 8,360,223 | B2 * | 1/2013 | Iwatsuki et al. | 194/206 |

(Continued)

FOREIGN PATENT DOCUMENTS

| | | |
|---|---|---|
| JP | 62-144548 | 6/1987 |

(Continued)

OTHER PUBLICATIONS

European Search Report (Application No. 09849814.0—PCT/JP2009/066730) (4 pages—dated Jun. 3, 2013).

*Primary Examiner* — Sang Kim

(74) *Attorney, Agent, or Firm* — Renner, Kenner, Greive, Bobak, Taylor & Weber

(57) ABSTRACT

The present invention provides a banknote storing/feeding device 23 that can increase a storing amount of banknotes while the device is made compact as a whole.

The banknote storing/feeding device includes a winding roller 38 that winds and unwinds banknotes together with a tape 37, and a reel 40 that winds and unwinds the tape 37 with respect to the winding roller 38. The banknote storing/feeding device includes a motor 55 including a motor main body 56 disposed inside the winding roller 38, and a first drive axis 58 and a second drive axis 59 projecting from a first end portion side and a second end portion side of the motor main body 56. The banknote storing/feeding device includes a transmission mechanism 70 that transmits a drive force from the second drive axis 59 of the motor 55 to the reel 40. A drive force from the first drive axis 58 of the motor 55 is transmitted to the winding roller 38 to rotate the winding roller 38. A drive force of the second drive axis 59 of the motor 55 is transmitted to the reel 40 to rotate the reel 40.

4 Claims, 6 Drawing Sheets

(56) References Cited

U.S. PATENT DOCUMENTS

| | | | | |
|---|---|---|---|---|
| 8,544,845 | B2 * | 10/2013 | Okamoto | 271/275 |
| 2005/0119098 | A1 * | 6/2005 | Yamamoto et al. | 492/60 |
| 2009/0108115 | A1 * | 4/2009 | Iwatsuki | 242/370 |

FOREIGN PATENT DOCUMENTS

| | | | |
|---|---|---|---|
| JP | 08-067382 | | 3/1996 |
| JP | 11-139617 | | 5/1999 |
| JP | 11-272913 | | 10/1999 |
| JP | 2000-123219 | | 4/2000 |
| JP | 2001-122470 | | 5/2001 |
| JP | 2001-266213 | | 9/2001 |
| JP | 2002-187662 | | 7/2002 |
| JP | 2003-312906 | | 11/2003 |
| JP | 2006-069708 | | 3/2006 |
| WO | WO 2009/003152 | A1 | 12/2008 |
| WO | WO 2009/050796 | A1 | 4/2009 |

* cited by examiner

PAPER SHEET STORING/FEEDING DEVICE

TECHNICAL FIELD

The present invention relates to a paper sheet storing/feeding device that stores and feeds paper sheets along with winding/unwinding of a tape.

BACKGROUND ART

Conventionally, for example, there is a banknote handling machine such as a banknote depositing and feeding machine for performing a process of depositing/feeding banknotes as paper sheets, which includes a tape-storing type banknote storing/feeding device using two tapes or one tape.

A banknote storing/feeding device using two tapes includes, as shown in FIG. 7, a winding roller 203 that winds and unwinds two tapes 201 and 202, and two reels 204 and 205 that wind and unwind the tapes 201 and 202, respectively, with respect to the winding roller 203. Further, a motor 206 is disposed between the winding roller 203 and the reels 204 and 205, and a drive force from this motor 206 is transmitted to the winding roller 203 and the reels 204 and 205 by a transmission mechanism 207. The transmission mechanism 207 includes pulleys 208, 209, 210, and 211 attached to the respective axes of the motor 206, the winding roller 203, and the reels 204 and 205, a belt 212 laid across the pulleys 208, 209, 210, and 211, one-way clutches 213 and 214 interposed between the axes of the reels 204 and 205 and the pulleys 210 and 211, and torque limiters not shown interposed between the axes of the reels 204 and 205 and the reels 204 and 205.

When storing a banknote, by driving the motor 206, the winding roller 203 rotates in a direction of winding the tapes 201 and 202, however, the drive force is not transmitted to the reels 204 and 205 by the one-way clutches 213 and 214, and the tapes 201 and 202 are pulled out from the reels 204 and 205. Therefore, a banknote 216 transported by a transport mechanism 215 is fed into the portion between the two tapes 201 and 202, sandwiched between the two tapes 201 and 202, and wound around the winding roller 203, and accordingly, the banknote 216 is stored.

When feeding a banknote, by driving the motor 206, the winding roller 203 rotates in a direction of unwinding the tapes 201 and 202, the reels 204 and 205 rotate at a speed enabling winding of lengths not less than the lengths unwound from the winding roller 203 of the tapes 201 and 202, the amounts to be unwound from the winding roller 203 of the tapes 201 and 202 are matched with the amounts to be wound by the reels 204 and 205 of the tapes 201 and 202 by the torque limiters, and while a fixed tension is applied to the tapes 201 and 202, the tapes 201 and 202 are wound by the reels 204 and 205. Therefore, by unwinding the two tapes 201 and 202 from the winding roller 203, a banknote 216 sandwiched between these unwound tapes 201 and 202 is fed into the transport mechanism 215 (for example, refer to PTL 1).

In addition, in a banknote storing/feeding device using one tape, by feeding a banknote into a portion between one tape to be wound around a winding roller and an outer peripheral surface of the winding roller, the banknote is wound around the winding roller together with the tape and stored although this is not illustrated. On the other hand, by unwinding the one tape from the winding roller, a banknote is fed from the portion between the unwound one tape and the outer peripheral surface of the winding roller.

In such a tape-storing type banknote storing/feeding device, in order to increase a banknote storing amount while the device is made compact as a whole, it is considered that the motor is installed at a different place to cope with an increase in diameter of the winding roller when winding a tape and an increase in diameter of the reels.

Although it would be better if the motor was installed outside the device, in a case where there is no place for installing the motor outside the device or a case where it is desired to include the motor in the banknote storing/feeding device as one unit, it is difficult to install the motor outside the device. Therefore, it is difficult to increase the banknote storing amount while the device is made compact as a whole.

A drum device in which a motor is installed inside a drum and the drum is rotated together with a rotor of the motor with respect to fixed shafts projecting from both end portions of the drum has been known (for example, refer to PTL 2). However, when this drum device is applied to a banknote storing/feeding device, drum devices are applied one each to the winding roller and the reel, and the number of motors increases and results in high cost although the device can be made compact as a whole.

CITATION LIST

Patent Literature

PTL 1: Japanese Laid-Open Patent Publication No. 11-139617 (page 3 to 4, FIGS. 4 and 5)

PTL 2: Japanese Laid-Open Patent Publication No. 62-144548 (page 1, FIG. 1)

SUMMARY OF INVENTION

Technical Problem

An object of the present invention is to provide a paper sheet storing/feeding device which can increase a paper sheet storing amount while the device is made compact as a whole.

Solution to Problem

A paper sheet storing/feeding device according to claim 1 of the invention that stores paper sheets transported from the outside and feeds the stored paper sheets to the outside, including: at least one tape; a winding roller that winds and unwinds the paper sheets together with the tape; a reel that winds and unwinds the tape with respect to the winding roller; a motor that includes a motor main body at least a part of which is disposed inside the winding roller, and a first drive axis and a second drive axis projecting from a first end portion side and a second end portion side of the motor main body, and rotates the winding roller by a drive force transmitted from the first drive axis and rotates the reel by a drive force transmitted from the second drive axis; and a transmission mechanism that transmits the drive force from the second drive axis of the motor to the reel.

At least a part of the motor main body is disposed inside the winding roller, and the winding roller is rotated by transmitting a drive force from the first drive axis projecting from the first end portion side of the motor main body to the winding roller, and the reel can be rotated by transmitting a drive force from the second drive axis projecting from the second end portion side of the motor main body to the reel via the transmission mechanism, so that only one motor is used, and therefore, the paper sheet storing amount can be increased while the device is made compact as a whole.

In a paper sheet storing/feeding device according to claim 2, in the paper sheet storing/feeding device according to claim 1, the motor includes a speed reducer that reduces the speed of rotation of the first drive axis.

The rotation speeds of the first drive axis and the second drive axis can be made different from each other, and the winding roller and each reel can be rotated at appropriate rotation speeds.

In a paper sheet storing/feeding device according to claim 3, in the paper sheet storing/feeding device according to claim 1, the winding roller is supported so as to rotate integrally with the first drive axis, and the paper sheet storing/feeding device includes a support body that has a first support portion and a second support portion disposed on outer sides of the first end portion and the second end portion of the winding roller respectively, the first support portion rotatably supporting the first drive axis by a bearing, and the second support portion supporting the motor main body.

By supporting the first drive axis rotatably on the first support portion of the support body by a bearing and supporting the motor main body on the second support portion, the motor can be supported and the winding roller can be supported rotatably with respect to the support body.

In a paper sheet storing/feeding device according to claim 4, in the paper sheet storing/feeding device according to claim 1, the transmission mechanism includes a one-way clutch that transmits a drive force from the motor to the reel when the motor is driven in a direction of unwinding the tape from the winding roller, and a torque limiter that cancels transmission of the drive force from the motor to the reel when a load of a predetermined torque or more is applied to the drive force to be transmitted from the motor to the reel.

When winding the tape around the winding roller, by driving the motor, the winding roller rotates in the direction of winding the tape, however, the drive force from the motor is not transmitted to the reel by the one-way clutch, and according to winding of the tape by the winding roller, the tape is pulled out from the reel, and the tape can be wound around the winding roller without slack. When unwinding the tape from the winding roller, by driving the motor, the winding roller rotates in the direction of unwinding the tape, and each reel rotates at a speed enabling the reel to wind a length not less than a length unwound from the winding roller of the tape, and the amount to be unwound from the winding roller of the tape and the amount to be wound by the reel of the tape are matched with each other by the torque limiter, and accordingly, the tape can be wound by the reel without slack.

Advantageous Effects of Invention

According to the paper sheet storing/feeding device of the present invention, the paper sheet storing amount can be increased while the device is made compact as a whole.

DESCRIPTION OF EMBODIMENTS

Hereinafter, embodiments of the present invention are described with reference to the drawings.

FIG. 1 to FIG. 4 show a first embodiment.

Figure 4:
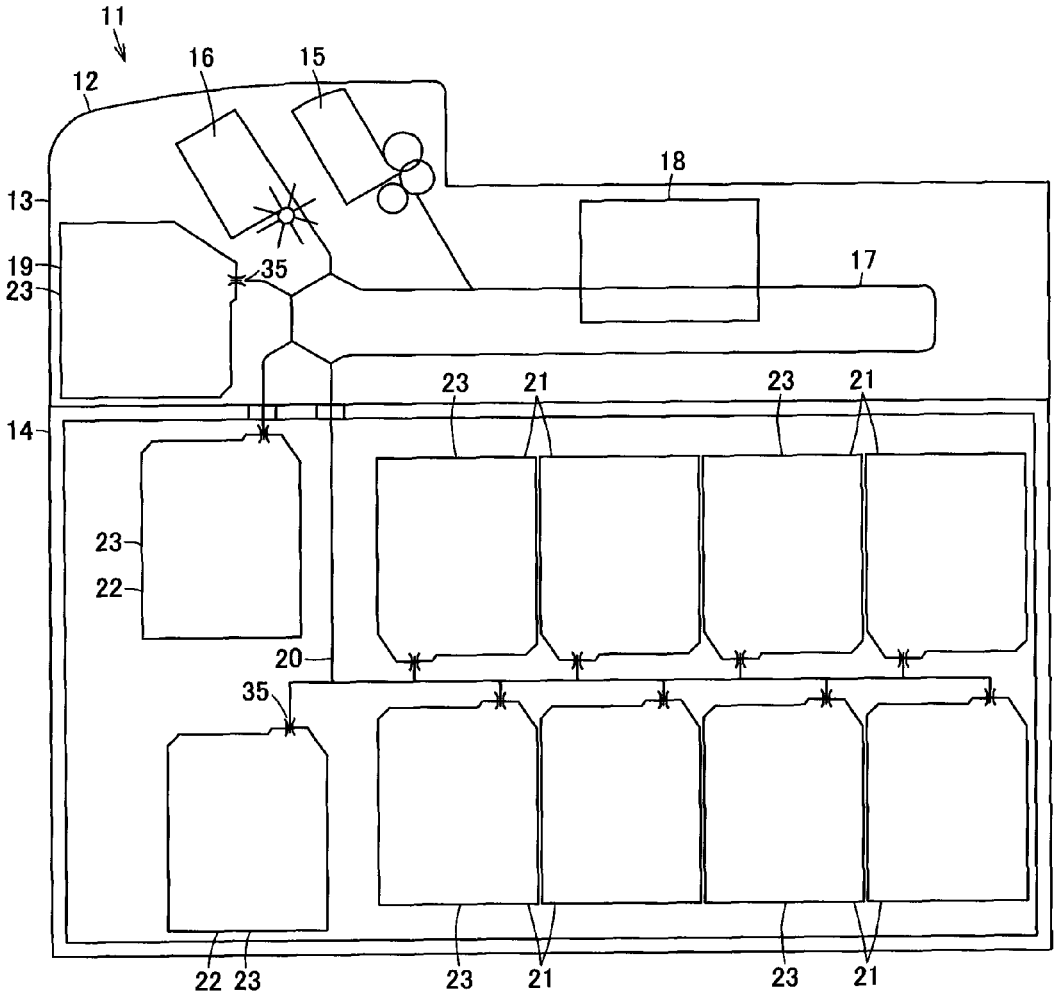
FIG. 4 is a sectional view of a paper sheet handling machine using the same paper sheet storing/feeding device.

FIG. 4 shows a banknote handling machine as a paper sheet handling machine. This banknote handling machine 11 is a banknote depositing/feeding machine that deposits and feeds banknotes as paper sheets, and in the machine body 12, an upper block 13 and a lower block 14 capable of being drawn out from the machine body 12 are provided.

In the upper block 13, an inlet 15 from which banknotes are deposited, an outlet 16 from which banknotes are fed, an upper transport path 17 for transporting banknotes, a recognition unit 18 that recognizes banknotes to be transported in the upper transport path 17, and an escrow unit 19 that stores banknotes fed from the upper transport path 17, are provided.

In the lower block 14, a lower transport path 20 connected to the upper transport path 17, denomination-specific banknote storing units 21 that store banknotes fed from the lower transport path 20, and banknote storing units 22 that store banknotes fed from the upper transport path 17 are provided.

The escrow unit 19 and the banknote storing units 21 and 22 consist of banknote storing/feeding devices 23 as paper sheet storing/feeding devices that store banknotes in a state where the banknotes are separated individually and feed stored banknotes one by one.

At each of the positions at which banknotes to be transported by the upper transport path 17 and the lower transport path 20 are diverted or joined together, a switching mechanism that smoothly diverts or joins banknotes is disposed.

A transporting direction of banknotes to be handled by the banknote handling machine 11 is a shorter-side direction orthogonal to the longitudinal direction of the banknote. The banknotes can be handled in the same manner even when the transporting direction of banknotes is the longitudinal direction of the banknote.

In a deposit process of the banknote handling machine 11, banknotes input into the inlet 15 are fed one by one into the upper transport path 17, and recognized by the recognition unit 18. Banknotes recognized as normal by the recognition unit 18 are transported to the escrow unit 19 and escrowed. After the process until the banknotes input into the inlet 15 are completed escrowed, when storing is instructed, the banknotes escrowed in the escrow unit 19 are fed one by one into the upper transport path 17 and recognized by the recognition unit 18, and then transported to the lower transport path 20, and transported to and stored in the banknote storing units 21 for corresponding denominations. By memorizing the storage order into the escrow unit 19, recognition by the recognition unit 18 may be omitted. When returning is instructed, banknotes escrowed in the escrow unit 19 are fed one by one into the upper transport path 17, and transported to the outlet 16 and returned.

In a feeding process of the banknote handling machine 11, banknotes stored in the banknote storing units 21 for denominations to be fed are fed one by one into the lower transport path 20, transported to the upper transport path 17, and recognized by the recognition unit 18, and banknotes recognized as normal are transported to the outlet 16 and fed.

Figure 1:
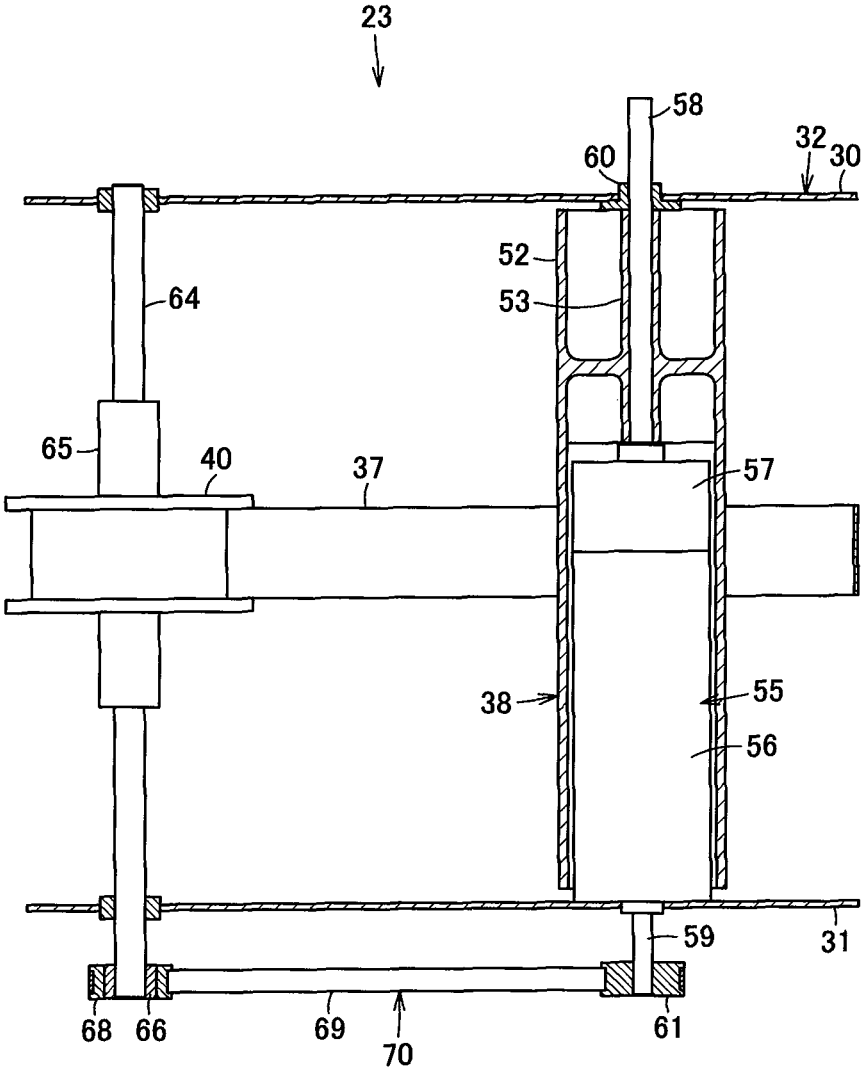
FIG. 1 is a plan view with partial cutaway of a paper sheet storing/feeding device showing a first embodiment of the present invention.
Figure 2:
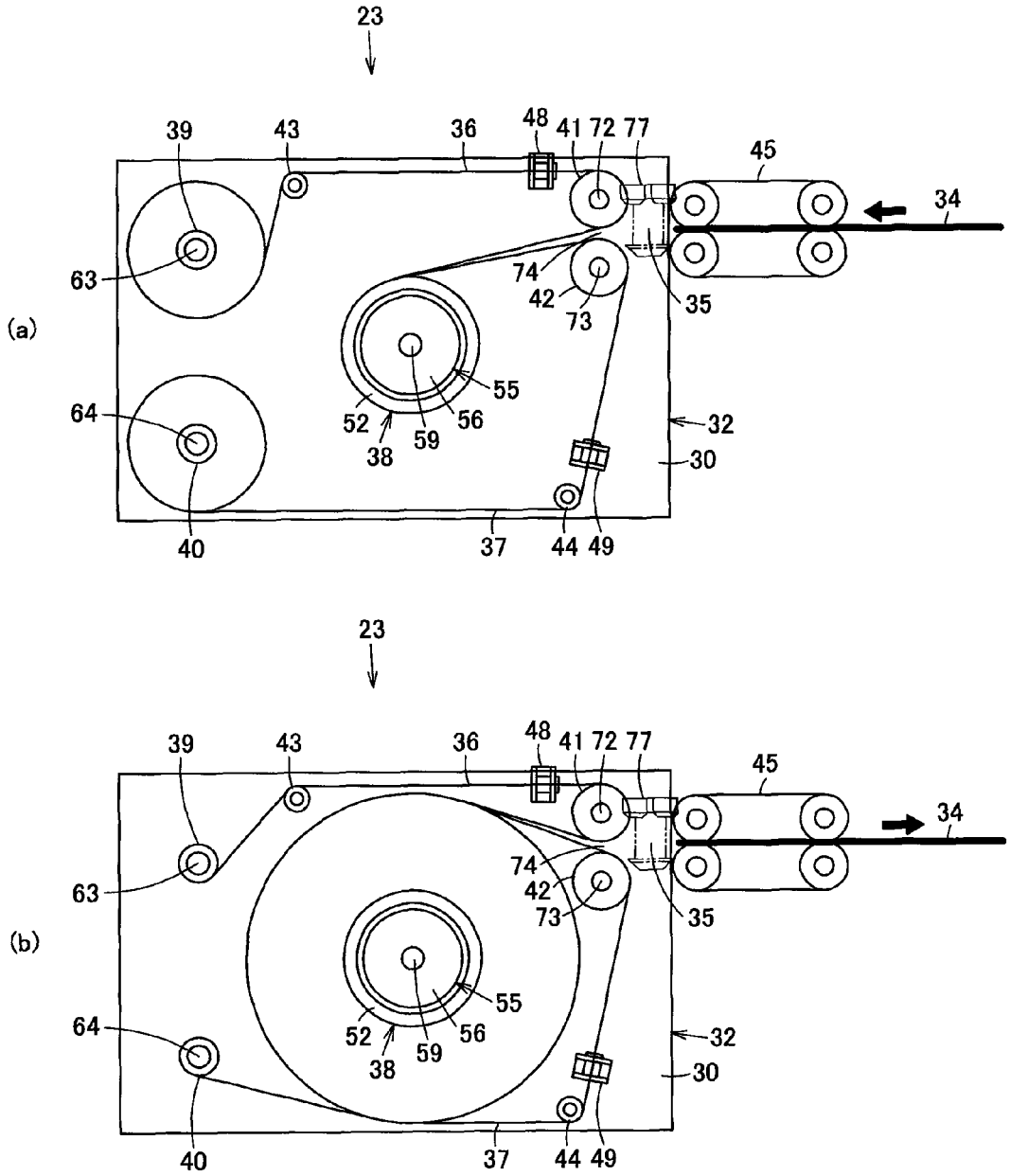
FIG. 2 are sectional views of the same paper sheet storing/feeding device, and FIG. 2(*a*) is a sectional view when no paper sheet is stored, and FIG. 2(*b*) is a sectional view when a maximum amount of paper sheets is stored.
Figure 3:
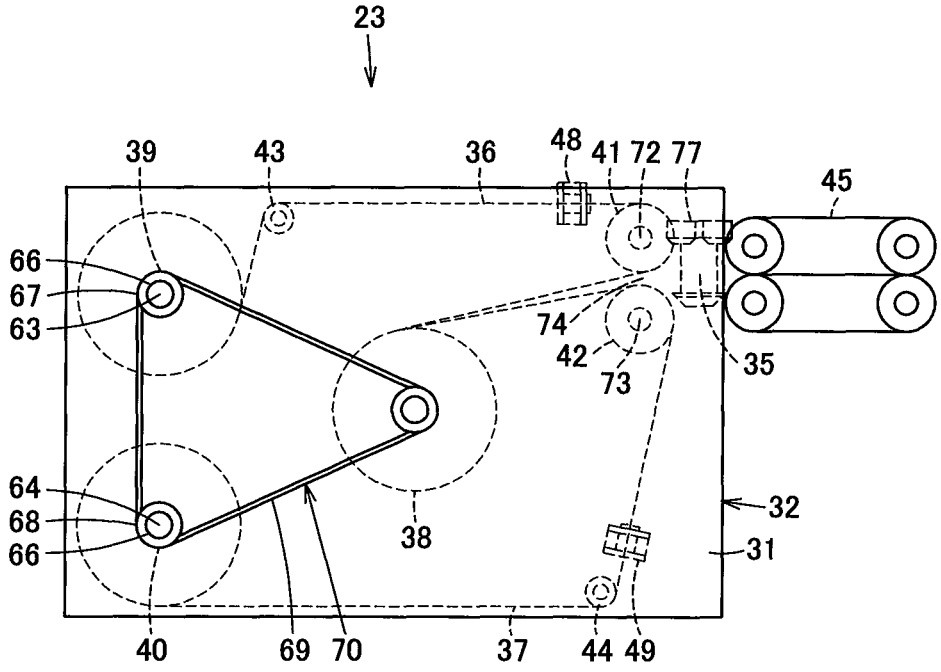
FIG. 3 is a side view of the same paper sheet storing/feeding device.

Next, the banknote storing/feeding device 23 is shown in FIG. 1 to FIG. 3.

The banknote storing/feeding device 23 includes a side plate 30 as a first support portion, a side plate 31 as a second support portion, and a support member 32 including a joint member not illustrated that joins these side plates 30 and 31.

Between the side plates 30 and 31 of this support body 32, a storing/feeding port 35 for inputting/outputting banknotes 34 as paper sheets into/from the upper transport path 17 or the lower transport path 20, a winding roller 38 to which first end portions of the first tape 36 and the second tape 37 are attached, a first reel 39 and a second reel 40 to which second end portions of the first tape 36 and the second tape 37 are attached, respectively, a first tape guide roller 41 and a second tape guide roller 42 that guide the tapes 36 and 37 at positions opposed to the storing/feeding port 35, and a first tape guide 43 and a second tape guide 44 that guide movements of the tapes 36 and 37 between the reels 39 and 40 and the tape guide rollers 41 and 42, etc., are disposed.

On the outward side of the storing/feeding port 35, the transport mechanism 45 of the upper transport path 17 or the lower transport path 20 for transporting banknotes 34 is disposed.

When storing a banknote, by winding the tapes 36 and 37 around the winding roller 38, a banknote 34 transported to the storing/feeding port 35 is sandwiched between the tapes 36 and 37 and wound around the winding roller 38 and stored, and when feeding a banknote, by winding the tapes 36 and 37 around the reels 39 and 40, that is, by unwinding the tapes 36 and 37 from the winding roller 38, the banknote 34 is fed to the storing/feeding port 35 from the portion between the tapes 36 and 37.

The tapes 36 and 37 have widths that are narrower than the width of the banknote 34 in a direction crossing the transporting direction of the banknote 34, that is, narrower than the width in the longitudinal direction of the banknote 34, and set to approximately ⅓ of the length in the longitudinal direction of the banknote 34. The banknote 34 is stored in a state where the central region in the width direction of the banknote 34 is sandwiched between the tapes 36 and 37 and both sides in the width direction of the banknote 34 project from the portion between the tapes 36 and 37. In the present embodiment, a pair of tapes 36 and 37 are used, however, a plurality of pairs of the tapes 36 and 37 can be used.

The second end portion region of the first tape 36 and the first end portion region of the second tape 37 are formed to be, for example, transparent so as to have predetermined or more light permeability, and regions other than these end portion regions are formed to be opaque so as not to have the predetermined or more light permeability.

Between the first tape guide roller 41 and the first tape guide 43, a wound tape end detection sensor 48 that detects the transparent portion of the second end portion region that becomes a terminal end of the first tape 36 when being wound around the winding roller 38 (when storing a banknote) is provided. Between the second tape guide roller 42 and the second tape guide 44, an unwound tape end detection sensor 49 that detects the transparent portion of the first end portion region that becomes a terminal end of the second tape 37 when being unwound from the winding roller 38 (when feeding a banknote) is provided.

The winding roller 38 has a cylindrical roller portion 52 with a diameter larger than the diameters of the reels 39 and 40, and on the first end portion side inside this roller portion 52, an axis attaching portion 53 is formed.

On the second end portion side of the winding roller 38, a motor 55 is disposed. This motor 55 is smaller in diameter than the roller portion 52 of the winding roller 38 and disposed without contact with the inner peripheral surface of the roller portion 52. The motor 55 includes a motor main body 56 as a drive source and a speed reducer 57 provided alongside the first end portion side of the motor main body 56. From the first end portion of the motor 55, that is, from the speed reducer 57, a first drive axis 58 that is rotated by a drive force of the motor main body 56 at a reduced speed via the speed reducer 57 projects, and from the second end portion of the motor 55, that is, from the motor main body 56, a second drive axis 59 that is directly driven to rotate by the motor main body 56 projects. When driving the motor 55, the first drive axis 58 rotates at a speed lower than that of the second drive axis 59, and the second drive axis 59 rotates at a speed higher than that of the first drive axis 58. To the first drive axis 58, an axis attaching portion 53 of the winding roller 38 is attached, and the winding roller 38 rotates integrally with the first drive axis 58. The first drive axis 58 projects from the first end portion of the winding roller 38.

The first drive axis 58 of the motor 55 is supported rotatably by a bearing 60 with respect to the side plate 30, and the second end portion of the motor main body 56 is attached to and supported by the side plate 31. Therefore, the motor 55 is supported between the side plates 30 and 31, and the winding roller 38 is supported rotatably by the motor 55. Then, a rotational drive force from the first drive axis 58 of the motor 55 is transmitted to the winding roller 38, and the winding roller 38 is driven to rotate.

On the outer side of the side plate 31, to an end portion of the second drive axis 59, a pulley 61 for transmitting the drive force to the reels 39 and 40 is attached.

The first reel 39 and the second reel 40 are attached to central positions in the axial directions of the first reel axis 63 and the second reel axis 64 laid rotatably across the side plates 30 and 31 on both sides via torque limiters 65. On the outer side of the side plate 31, to the end portion of the reel axis 63, 64, a pulley 67, 68 is attached via a one-way clutch 66.

On the outer side of the side plate 31, a belt 69 is laid across the pulley 61 of the motor 55 and the pulleys 67 and 68 of the reels 39 and 40.

For storing a banknote, when the motor 55 drives and rotates the winding roller 38 in the tape winding direction, the rotational drive force is not transmitted to the reels 39 and 40 by the one-way clutches 66, and on the other hand, for feeding a banknote, when the motor 55 drives and rotates the winding roller in the tape unwinding direction, the drive force is transmitted to the reels 39 and 40 via the one-way clutches 66, and the reels 39 and 40 rotate in the tape winding direction (clockwise in FIG. 2 and FIG. 3).

These pulley 61, the pulleys 67 and 68, and the belt 69 constitute a transmission mechanism 70 that transmits a drive force from the second drive axis 59 of the motor 55 to the reels 39 and 40. By this transmission mechanism 70, by transmitting a rotational drive force of the motor 55 to the reels 39 and 40 via the torque limiters 65 so that a speed at which the reels 39 and 40 rotate in the winding direction and winds the tapes 36 and 37 is always higher than a speed at which the tapes 36 and 37 are unwound from the winding roller 38, the tapes 36 and 37 can be wound by the reels 39 and 40 without slack. The transmission mechanism 70 uses the belt 69, however, it may be a transmission mechanism using gears.

The first tape guide roller 41 and the second tape guide roller 42 are flanged rollers having flanges on both sides for guiding the tapes 36 and 37 while restricting the positions in the width directions of the tapes 36 and 37, and are attached rotatably to a first roller axis 72 and a second roller axis 73 laid across the side plates 30 and 31 of the support body 32.

The tapes 36 and 37 extending from the reels 39 and 40 to the winding roller 38 are wound around these tape guide rollers 41 and 42 so as to be opposed to each other at a distance to form a substantially triangular space 74 at the winding position of these tapes 36 and 37. When storing a banknote, the space 74 functions so that the banknote 34 is received in the space 74 and wound by the winding roller 38 while being sandwiched and held by the tapes 36 and 37.

At the storing/feeding port 35, a banknote detection sensor 77 that detects a banknote 34 passing through the storing/feeding port 35 so as to be stored or fed is provided.

Next, operations of the banknote storing/feeding device 23 according to the first embodiment are described.

First, the operation for storing a banknote is described.

As shown in FIG. 2(*a*), when a banknote 34 is transported to the banknote storing/feeding device 23 by the transport mechanism 45, by detecting the banknote 34 by a sensor not illustrated provided in the transport mechanism 45, the motor 55 is driven to rotate in a direction corresponding to a banknote storing direction. According to this rotational driving of the motor 55, the first drive axis 58 rotates at a low speed and the second drive axis 59 rotates at a high speed.

The winding roller 38 rotates in the tape winding direction integrally with the first drive axis 58, and this winding roller 38 starts to wind the tapes 36 and 37.

The pulley 61 rotates together with the second drive axis 59, and the pulleys 67 and 68 of the reels 39 and 40 also rotate via the belt 69, however, this rotational drive force is not transmitted to the reel axes 63 and 64 by the one-way clutches 66, and the reel axes 63 and 64 do not rotate in the direction of tape unwinding from the reels 39 and 40. Further, the reel axes 63 and 64 are obstructed from rotating in the direction of tape unwinding from the reels 39 and 40 by the one-way clutches 66, so that the reels 39 and 40 attached to the reel axes 63 and 64 via the torque limiters 65 do not rotate in the tape unwinding direction, and the tapes 36 and 37 to be wound by the winding roller 38 are tensioned.

When the tension applied to the tapes 36 and 37 becomes larger than a predetermined torque value of the torque limiters 65, the torque limiters 65 slip and the reels 39 and 40 rotate in the tape unwinding direction. Therefore, from the reels 39 and 40, the tapes 36 and 37 are unwound while a fixed tension is applied thereto.

Therefore, the banknote 34 transported by the transport mechanism 45 is sandwiched between the tapes 36 and 37, and the banknote 34 is wound by the winding roller 38 together with the tapes 36 and 37 and stored.

When passage of the banknote 34 to be wound and stored around the winding roller 38 is detected by the banknote detection sensor 77, by stopping the motor 55, the winding roller 38 is braked to stop its rotation, and storing of one banknote 34 is completed.

Subsequently, by detecting a banknote 34 to be stored next by a sensor not illustrated provided in the transport mechanism 45, the motor 55 is driven to rotate again in the direction corresponding to the banknote storing direction, and the above-described storing operation is repeated.

Then, as shown in FIG. 2(*a*), when the banknotes 34 are not stored yet, the outer diameter of the winding roller 38 is small, however, as shown in FIG. 2(*b*), by winding the tapes 36 and 37 and the banknote 34 around the winding roller 38, the outer diameter of the portion at which the tapes 36 and 37 and the banknote 34 are wound by the winding roller 38 increases.

Next, operations for feeding a banknote are described.

In FIG. 2(*b*), the motor 55 is driven to rotate in a direction corresponding to a banknote feeding direction. According to this rotational driving of the motor 55, the first drive axis 58 rotates at a low speed and the second drive axis 59 rotates at a high speed.

The winding roller 38 rotates in the tape unwinding direction together with the first drive axis 58 and starts to unwind the tapes 36 and 37 from the winding roller 38.

At the same time, the pulleys 67 and 68 of the reels 39 and 40 also rotate via the pulley 61 and the belt 69 as well as the second drive axis 59, and via the one-way clutches 66 of these pulleys 67 and 68, the reel axes 63 and 64 rotate in a direction corresponding to the tape winding direction. At this time, the one-way clutches 66 transmit a rotational drive force so that the reel axes 63 and 64 rotate in the tape winding direction. Therefore, according to rotation of the reel axes 63 and 64, the reels 39 and 40 rotate in the tape winding direction via the torque limiters 65, and the tapes 36 and 37 are wound by the reels 39 and 40.

At this time, by designing the device so that the speed of tape winding by the reels 39 and 40 becomes higher than the speed of tape unwinding from the winding roller 38 regardless of a tape winding amount ratio of the reels 39 and 40 to the winding roller 38, the tapes 36 and 37 to be wound by the reels 39 and 40 are always tensioned.

Specifically, when the tension of the tapes 36 and 37 becomes larger than the predetermined torque value of the torque limiters 65, the torque limiters 65 slip, and while a fixed torque is applied, the reels 39 and 40 rotate in the same tape winding direction at a rotation speed lower than that of the reel axes 63 and 64. Therefore, the tapes 36 and 37 are wound around the reels 39 and 40 while a fixed tension is applied thereto.

By unwinding the tapes 36 and 37 from the winding roller 38, the banknote 34 is unwound together with the tapes 36 and 37. The banknote 34 unwound from the winding roller 38 is fed from the portion between the tapes 36 and 37 to the transport mechanism 45 through the storing/feeding port 35.

In a case where the number of banknotes 34 to be fed is one, when passage of the banknote 34 to be fed is detected by the banknote detection sensor 77, by stopping the motor 55, the winding roller 38 is braked to stop rotating.

To feed a plurality of banknotes 34, the motor 55 is continuously driven until passage of the banknotes 34 to be fed is detected by the banknote detection sensor 77, and when passage of the banknote 34 to be fed last is detected by the banknote detection sensor 77, by stopping the motor 55, the winding roller 38 is braked to stop rotating.

Then, as shown in FIG. 2(*b*), in the state where the tapes 36 and 37 and the banknote 34 are wound by the winding roller 38, the outer diameter of the portion at which the tapes 36 and 37 and the banknote 34 are wound by the winding roller 38 is large, however, as shown in FIG. 2(*a*), by unwinding the tapes 36 and 37 and the banknote 34 from the winding roller 38, the outer diameter of the winding roller 38 becomes smaller.

Thus, in the banknote storing/feeding device 23, the motor main body 56 of the motor 55 is disposed inside the winding roller 38, the winding roller 38 can be rotated by transmitting a drive force from the first drive axis 58 projecting from the first end portion side of the motor main body 56 to the winding roller 38, and the reels 39 and 40 can be rotated by transmitting a drive force from the second drive axis 59 projecting from the second end portion side of the motor main body 56 to the reels 39 and 40 via the transmission mechanism 70, so that only one motor 55 is used, and therefore, while the device is made compact as a whole, the storing amount of the banknotes 34 can be increased.

Figure 7:
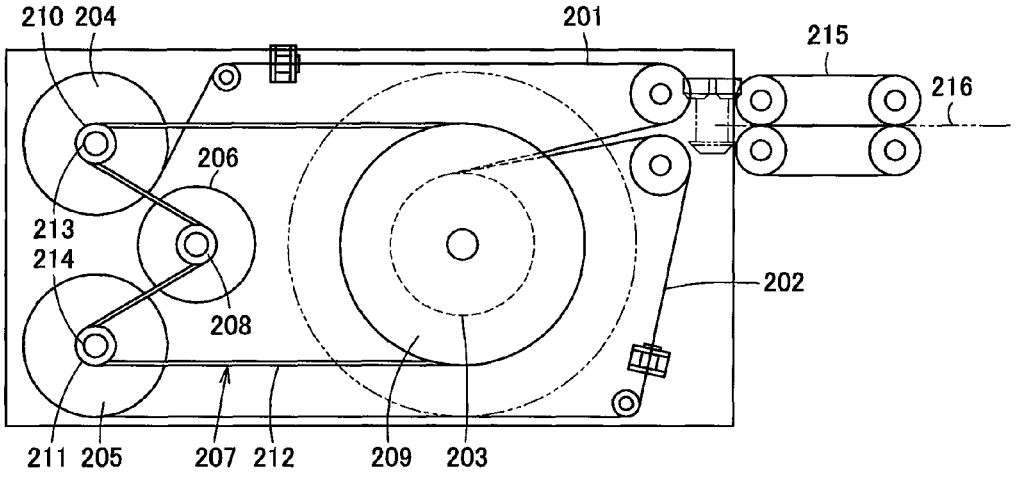
FIG. 7 is a sectional view of a conventional paper sheet storing/feeding device.

Specifically, in the conventional banknote storing/feeding device shown in FIG. 7, a motor 206 is disposed between the winding roller 203 and the reels 204 and 205, so that it is difficult to increase the storing amount of the banknotes 216 while the device is made compact as a whole, however, as shown in FIG. 1 and FIG. 3, by disposing the motor 55 inside the winding roller 38, a space can be formed between the winding roller 38 and the reels 39 and 40, and these winding roller 38 and reels 39 and 40 can be disposed close to each other, so that while the device is made compact as a whole, the outer diameter of the portion at which the tapes 36 and 37 and the banknote 34 are wound by the winding roller 38 can be allowed to increase, and the storing amount of the banknotes 34 can be increased.

Further, the motor 55 includes the speed reducer 57 that reduces the speed of rotation of the first drive axis 58, so that by making the rotation speeds of the first drive axis 58 and the second drive axis 59 different from each other, the winding roller 38 and the reels 39 and 40 can be driven at respective appropriate rotation speeds by the first drive axis 58 and the second drive axis 59.

Of the side plates 30 and 31 on both sides of the support body 32, on the side plate 30, the first drive axis 58 can be supported rotatably by the bearing 60, and on the side plate 31, the motor main body 56 is supported, and therefore, the motor 55 can be supported and the winding roller 38 can be supported rotatably with respect to the support body 32.

When winding the tapes 36 and 37 around the winding roller 38, by driving the motor 55, the winding roller 38 rotates in the direction of winding the tapes 36 and 37, however, the drive force from the motor 55 is not transmitted to the reels 39 and 40 by the one-way clutches 66, and according to winding of the tapes 36 and 37 by the winding roller 38, the tapes 36 and 37 are pulled out from the reels 39 and 40, and the tapes 36 and 37 can be wound by the winding roller 38 without slack. Further, when unwinding the tapes 36 and 37 from the winding roller 38, by driving the motor 55, the winding roller 38 rotates in the direction of unwinding the tapes 36 and 37, and the reel 39 and 40 rotate at a speed at which the reels can wind lengths not less than the lengths to be unwound from the winding roller 38 of the tapes 36 and 37, and by matching the amounts to be unwound from the winding roller 38 of the tapes 36 and 37 and the amounts to be wound by the reels 39 and 40 with each other by the torque limiters 65, and accordingly, the tapes 36 and 37 can be wound by the reels 39 and 40 without slack.

Figure 5:
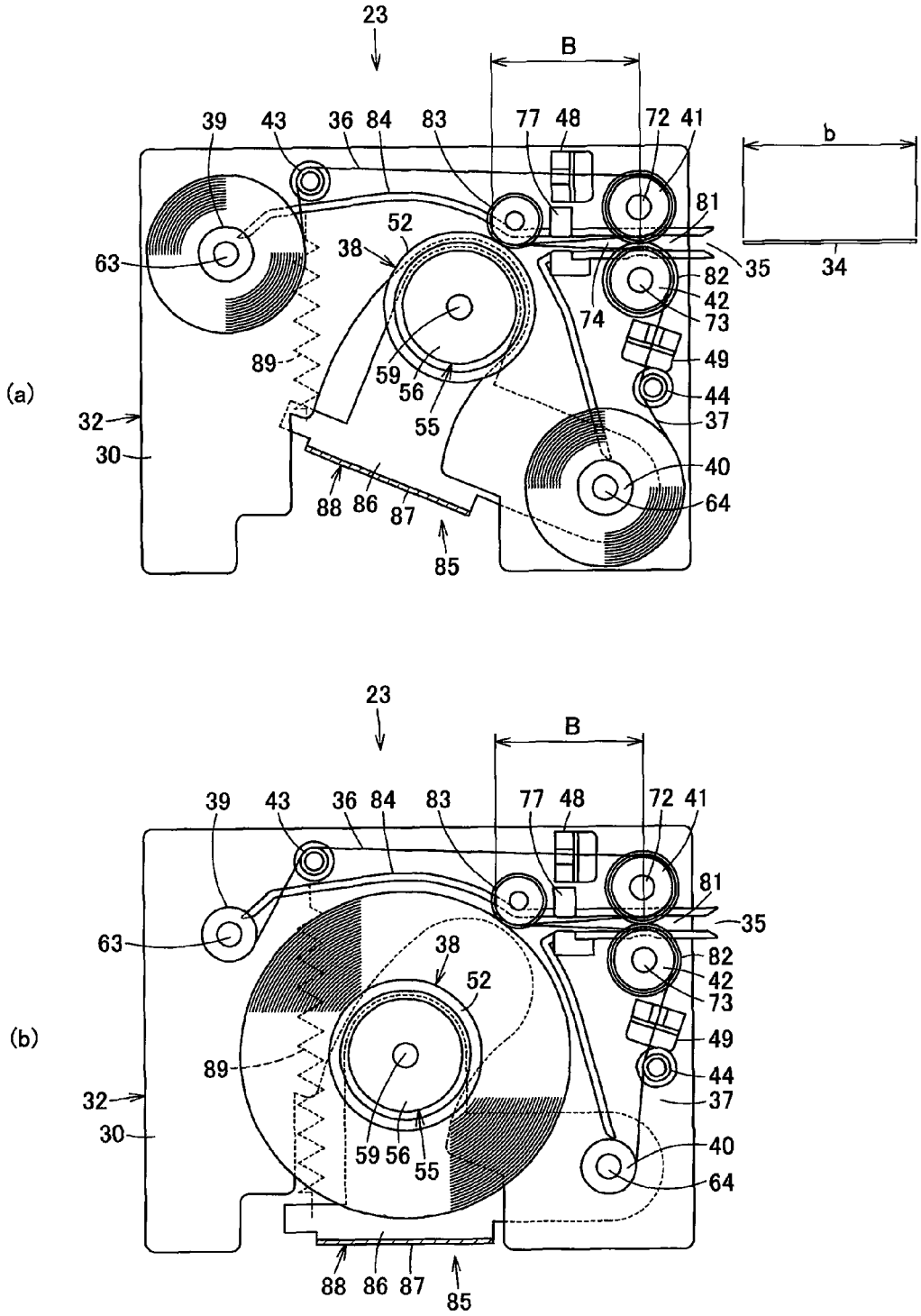
FIG. 5 are sectional views of a paper sheet storing/feeding device showing a second embodiment of the present invention, and FIG. 5(*a*) is a sectional view when no paper sheet is stored, and FIG. 5(*b*) is a sectional view when a maximum amount of paper sheets is stored.
Figure 6:
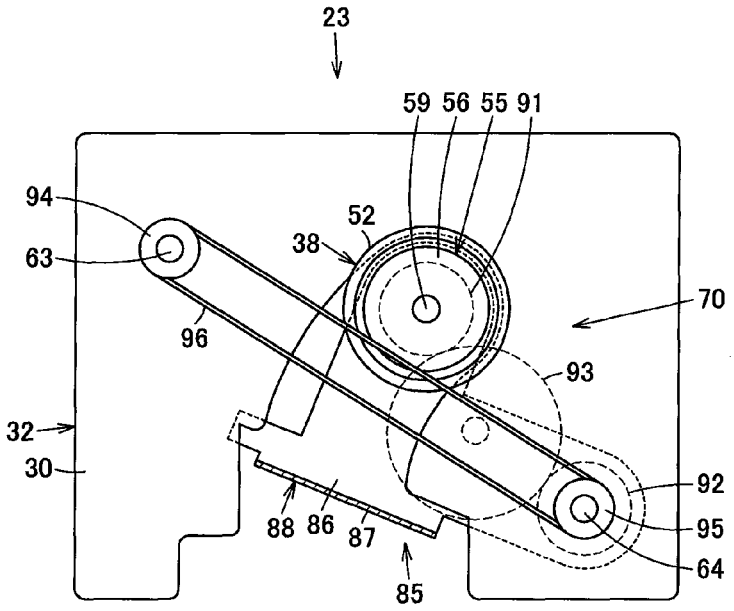
FIG. 6 is a sectional view showing a transmission mechanism of the same paper sheet storing/feeding device.

Next, a second embodiment is shown in FIG. 5 and FIG. 6. The same components as in the first embodiment are described by using the same reference numerals.

As shown in FIG. 5, in the banknote storing/feeding device 23 according to the second embodiment, the second reel 40 and the second reel axis 64 are disposed below the tape guide rollers 41 and 42 of the storing/feeding port 35.

On the first roller axis 72 of the first tape guide roller 41, first transport rollers 81 for transporting a banknote 34 are supported rotatably at both side positions of the first tape guide roller 41, and to the second roller axis 73 of the second tape guide roller 42, second transport rollers 82 for transporting a banknote 34 by sandwiching the banknote 34 with the first transport rollers 81 are attached at both side positions of the second tape guide roller 42. These transport rollers 81 and 82 are rotated by a drive force transmitted from the transport mechanism 45 side, and transport the banknote 34 in conjunction with the transport mechanism 45. The transport rollers 81 and 82 sandwich a banknote 34 transported from the transport mechanism 45 and feed the banknote into the portion between the tapes 36 and 37 when storing the banknote, and sandwich the banknote 34 fed from the portion between the tapes 36 and 37 by unwinding from the winding roller 38 and transport the banknote to the transport mechanism 45 when feeding the banknote.

Further, a guide roller 83 that guides winding and unwinding of the tapes 36 and 37 and the banknote 34 with respect to the winding roller 38 is provided. Further, a guide cover 84 that guides the banknote 34 from the storing/feeding port 35 to the outer peripheral surface of the winding roller 38 is provided.

The winding roller 38 is supported movably in a direction of changing the distance between the center of the winding roller 38 and the guide roller 83 by a winding roller movement mechanism 85. This winding roller movement mechanism 85 includes side plate portions 86 and 86 disposed on the outer sides of the side plates 30 and 31 of the support body 32 and a support member 88 on which a joint plate portion 87 for joining these side plate portions 86 and 86 is formed. The support member 88 is supported on the support body 32 swingably around the second reel axis 64, and biased toward a direction of reducing the distance between the center of the winding roller 38 and the guide roller 83 by springs 89 and 89 laid across the side plate portions 86 and 86 and the side plates 30 and 31 of the support body 32.

The first drive axis 58 of the motor 55 is supported rotatably by a bearing with respect to the side plate portion 86 on the first end portion side of the support member 88, and the second end portion of the motor main body 56 is attached to and supported by the side plate portion 86 on the second end portion side of the support member 88. Therefore, between the side plate portions 86 and 86 of the support member 88, the motor 55 is supported, and the winding roller 38 is supported rotatably by this motor 55. Then, a rotational drive force from the first drive axis 58 of the motor 55 is transmitted to the winding roller 38, and accordingly, the winding roller 38 is driven to rotate.

In the transport mechanism 45, a position between the transport rollers 81 and 82 that hold and transport the banknote 34 at a position closest to the winding roller 38 is defined as a transport path side holding position A1, a position near the guide roller 83 that holds the banknote 34 by winding the tapes 36 and 37 around the winding roller 38 is defined as a winding roller side holding position A2, and a holding position distance B between these transport path side holding position A1 and the winding roller side holding position A2 is set to be smaller than the length b in the transporting direction of the banknote 34.

The winding roller movement mechanism 85 moves the winding roller 38 so as to change the distance between the center of the winding roller 38 and the transport path side holding position A1 according to an amount of tape winding by the winding roller 38 while maintaining the holding position distance B smaller than the length b in the transporting direction of the banknote 34.

As shown in FIG. 6, the transmission mechanism 70 that transmits the drive force from the second drive axis 59 of the motor 55 to the reels 39 and 40 is configured as follows. An intermediate gear 93 attached rotatably to the outer surface of the side plate portion 86 of the support member 88 meshes with a gear 91 attached to the second drive axis 59 and a gear 92 attached to the second end portion of the second reel axis 64, and the drive force from the second drive axis 59 of the motor 55 is transmitted to the second reel axis 64. Further, a belt 96 is laid across a pulley 94 attached to the first end portion of the second reel axis 64 and a pulley 95 attached to the first end portion of the first reel axis 63, and the drive force from the second drive axis 59 of the motor 55 is transmitted to the first reel 39 via the second reel axis 64, the pulleys 94 and 95, and the belt 96. The transmission mechanism 70 includes torque limiters 65 and a one-way clutch 66 that function in the same manner as in the first embodiment, however, the one-way clutch 66 is interposed between the gear 92 and the second reel axis 64.

Next, operations of the banknote storing/feeding device 23 of the second embodiment are described.

The operation for storing the banknote 34 when storing the banknote and the operation for feeding the banknote 34 when feeding the banknote are basically the same as in the first embodiment described above, so that descriptions of these are omitted. Here, operations relating to movements of the winding roller 38 are described.

FIG. 5(*a*) shows a state where the banknotes 34 are not stored yet and FIG. 5(*b*) shows a change in outer diameter of the portion at which the tapes 36 and 37 and banknotes 34 are wound by the winding roller 38 when a maximum amount of banknotes 34 are stored.

As shown in FIG. 5(*a*), when the banknotes 34 are not stored yet, due to biasing by the springs 89 of the winding roller movement mechanism 85, the distance between the center of the winding roller 38 and the guide roller 83 is minimized, that is, the center of the winding roller 38 comes closest to the guide roller 83, and the outer peripheral surface of the winding roller 38 is pressed against the guide roller 83.

When the banknote 34 is stored by winding the tapes 36 and 37 around the winding roller 38, the outer diameter of the winding roller 38 (the outer diameter at the outer peripheral portion of the tapes 36 and 37 and the banknote 34 wound by the winding roller 38) increases, so that against biasing by the springs 89, the center of the winding roller 38 moves to separate from the guide roller 83. Specifically, the center of the winding roller 38 moves in a direction of separating from the guide roller 83, and accordingly, the winding roller 38 that winds the tapes 36 and 37 and the banknotes 34 is allowed to increase in outer diameter.

Even after the outer diameter of the winding roller 38 increases and the center of the winding roller 38 separates from the guide roller 83, the holding position distance B between the transport path side holding position A1 and the winding roller side holding position A2 does not greatly change, but is maintained to be smaller than the length b in the transporting direction of the banknote 34, so that stable storing of the banknote 34 is realized.

As the banknote 34 is fed by unwinding the tapes 36 and 37 from the winding roller 38, the outer diameter of the winding roller 38 (the outer diameter at the outer peripheral portion of the tapes 36 and 37 and the banknote 34 wound around the winding roller 38) becomes smaller, so that due to biasing by the springs 89, the center of the winding roller 38 moves closer to the guide roller 83. Specifically, the center of the winding roller 38 moves in a direction of approaching the guide roller 83, and accordingly, the winding roller 38 that winds the tapes 36 and 37 and the banknote 34 is allowed to become smaller in outer diameter.

Even after the outer diameter of the winding roller 38 becomes smaller and the center of the winding roller 38 moves closer to the guide roller 83, the holding position distance B between the transport path side holding position A1 and the winding roller side holding position A2 does not greatly change, but is maintained to be smaller than the length b in the transporting direction of the banknote 34, so that stable feeding of the banknotes 34 is realized.

Thus, in the banknote storing/feeding device 23, by the winding roller movement mechanism 85, by moving the winding roller 38 so as to change the distance between the center of the winding roller 38 and the transport path side holding position A1 according to the amount of tape to be wound by the winding roller 38 while maintaining the holding position distance B smaller than the length b in the transporting direction of the banknote 34, the outer diameter of the winding roller 38 when winding the tapes can be increased and the storing amount of the banknotes 34 can be increased, and even when the outer diameter of the winding roller 38 when winding the tapes increases, stable storing and feeding of the banknotes 34 are enabled.

In the second embodiment described above, the winding roller movement mechanism 85 may move the center of the winding roller 38 by using driving by a drive unit such as a motor according to the outer diameter of the winding roller 38 that wound the tapes 36 and 37. The winding roller 38 is supported by the support member 88 swingably around the second reel axis 64, however, the winding roller 38 may be supported slidably linearly.

In the first and second embodiments described above, the present invention is also applicable to a banknote storing/feeding device 23 that winds banknotes 34 by one single tape 36 without using the second tape 37. In this case, by feeding the banknote 34 into the portion between the single tape 36 to be wound around the winding roller 38 and the outer peripheral surface of the winding roller 38, the banknote 34 is wound around the winding roller 38 together with the single tape 36 and stored, and on the other hand, by unwinding the single tape 36 from the winding roller 38, the banknote 34 is fed from the portion between the single unwound tape 36 and the outer peripheral surface of the winding roller 38.

INDUSTRIAL APPLICABILITY

The present invention is applicable to an escrow unit that escrows banknotes and a banknote storing unit that stores and feeds banknotes, etc., in a banknote handling machine, and further applicable to a paper sheet handling machine that handles paper sheets such as checks, slips, and sheets.

REFERENCE SIGNS LIST

23 Banknote storing/feeding device as paper sheet storing/feeding device
30 Side plate as first support portion
31 Side plate as second support portion
32 Support body
34 Banknote as paper sheet
36, 37 Tape
38 Winding roller
39, 40 Reel
55 Motor
45 Motor main body
57 Speed reducer
58 First drive axis
59 Second drive axis
60 Bearing
65 Torque limiter
66 One-way clutch
70 Transmission mechanism

The invention claimed is:

1. A paper sheet storing/feeding device that stores paper sheets transported from the outside and feeds the stored paper sheets to the outside, comprising:

at least one tape;

a winding roller that winds and unwinds the paper sheets together with the tape;

a reel that winds and unwinds the tape with respect to the winding roller;

a motor that includes a motor main body at least a part of which is disposed inside the winding roller, and a first drive axis projecting from a first end portion side and a second drive axis projecting from a second end portion side of the motor main body, the second end portion side being opposite to the first end portion side, and rotates the winding roller by a drive force transmitted from the first drive axis and rotates the reel by a drive force transmitted from the second drive axis; and a transmission mechanism that transmits the drive force from the second drive axis of the motor to the reel.

2. The paper sheet storing/feeding device according to claim 1, wherein the motor includes a speed reducer that reduces the speed of rotation of the first drive axis.

3. The paper sheet storing/feeding device according to claim 1, wherein the winding roller is supported so as to rotate integrally with the first drive axis, and the paper sheet storing/feeding device includes a support body that has a first support portion and a second support portion disposed on outer sides of the first end portion and the second end portion of the winding roller respectively, the first support portion rotatably supporting the first drive axis by a bearing, and the second support portion supporting the motor main body.

4. The paper sheet storing/feeding device according to claim 1, wherein the transmission mechanism includes:

a one-way clutch that transmits a drive force from the motor to the reel when the motor is driven in a direction of unwinding the tape from the winding roller, and a torque limiter that cancels transmission of the drive force from the motor to the reel when a load of a predetermined torque or more is applied to the drive force to be transmitted from the motor to the reel.

* * * * *